United States Patent [19]

O'Shea et al.

[11] Patent Number: 4,937,715

[45] Date of Patent: Jun. 26, 1990

[54] LAMP SYSTEM FOR OPERATING THEATRES AND THE LIKE

[75] Inventors: Donald C. O'Shea, Atlanta; James L. Oliver, Norcross; James L. Sketo, Stockbridge, all of Ga.

[73] Assignee: Kirschner Medical Corporation, Timonium, Md.

[21] Appl. No.: 302,566

[22] Filed: Jan. 26, 1989

[51] Int. Cl.[5] ..... F21V 5/00

[52] U.S. Cl. ..... 362/268; 362/331; 362/335; 362/804

[58] Field of Search ..... 362/268, 311, 331, 332, 362/337, 339, 376, 804, 309

[56] References Cited

U.S. PATENT DOCUMENTS

| | | | |
|---|---|---|---|
| Re. 24,372 | 10/1957 | Franck | 362/309 |
| 1,122,409 | 1/1872 | Skelton | 362/297 |
| 1,180,748 | 4/1916 | Williamson | 362/309 |
| 1,235,674 | 8/1917 | Ford | 362/339 |
| 1,263,696 | 4/1918 | Newton | 362/339 |
| 1,276,924 | 8/1918 | Hunt | 362/339 |
| 1,364,866 | 1/1921 | Champeau | 362/309 |
| 1,374,900 | 4/1921 | Benzer et al. | 362/337 |
| 1,420,977 | 6/1922 | Dorey | 362/309 |
| 1,541,706 | 6/1925 | Hamburg | 362/337 |
| 1,569,217 | 1/1926 | Dake | 362/337 |
| 1,709,218 | 4/1929 | Harris | 362/297 |
| 1,724,727 | 8/1929 | Rolph et al. | 362/337 |
| 1,839,022 | 12/1931 | Froget | 362/333 |
| 2,017,075 | 10/1935 | Rolph et al. | 362/307 |
| 2,082,100 | 6/1937 | Dorey et al. | 362/309 |
| 2,089,693 | 8/1937 | English | 362/332 |
| 2,175,067 | 10/1939 | Rolph | 362/337 |
| 2,201,860 | 5/1940 | English | 362/307 |
| 2,260,693 | 10/1941 | Rolph | 362/309 |
| 2,310,810 | 2/1943 | Rolph | 362/331 |
| 2,328,329 | 8/1943 | Dickson | 362/334 |
| 2,344,295 | 3/1944 | Franck | 362/339 |
| 2,493,087 | 1/1950 | Rolph | 362/309 |
| 2,495,320 | 1/1950 | Franck | 362/309 |
| 2,827,554 | 3/1958 | Gunther et al. | 362/33 |
| 3,020,395 | 2/1962 | Peltz | 362/330 |
| 3,179,796 | 4/1965 | Rolph | 362/339 |
| 3,225,184 | 12/1965 | Reiber | 362/33 |
| 3,274,383 | 9/1966 | Dorman | 362/334 |
| 3,320,415 | 5/1967 | Neal et al. | 362/334 |
| 3,340,393 | 9/1967 | Franck et al. | 362/309 |
| 3,360,640 | 12/1967 | Seitz et al. | 362/12 |
| 3,502,865 | 3/1970 | Matteson | 362/309 |
| 3,732,417 | 5/1973 | Nordquist | 362/309 |
| 3,941,993 | 3/1976 | Hubert | 362/309 |
| 4,135,231 | 1/1979 | Fisher | 362/269 |
| 4,153,929 | 5/1979 | Laudenschlarger | 362/348 |
| 4,159,511 | 6/1979 | Dejond | 362/804 X |
| 4,633,377 | 12/1986 | MacKiewicz | 362/309 |

FOREIGN PATENT DOCUMENTS

| | | | |
|---|---|---|---|
| 1495007 | 8/1967 | France | 362/33 |
| 420922 | 12/1934 | United Kingdom | 362/340 |

*Primary Examiner*—Stephen F. Husar

*Attorney, Agent, or Firm*—Frost & Jacobs

[57] ABSTRACT

The present invention relates to a lamp for providing uniform luminosity in an area to be illuminated, such as in an operating theatre and the like, comprising generally (a) a light source, (b) a planar field, said planar field comprising a substantial number of radial sectors containing a plurality of transverse, outwardly curved prisms, and (c) a toroidal lens system which controls the divergence of the light emanating from the light source so as to render the light substantially columnate and direct the light onto the planar field. The present invention also includes structure whereby the radial sectors are held together in the planar field by attachment to one another, such as by tongue-and-groove means, and further includes (d) a transparent member located between the planar field and the area to be illuminated which protects the prism sectors from soil and injury.

9 Claims, 7 Drawing Sheets

PRIOR ART

| NO. | ANGLE | RADIUS | R TOL. |
|---|---|---|---|
| 1 | 65° 10' | 10.5 | |
| 2 | 66° 10' | 12 | |
| 3 | 66° 35' | 13 | |
| 4 | 67° 25' | 15 | ±.25 |
| 5 | 67° 00' | 17 | |
| 6 | 66° 50' | 18 | |
| 7 | 66° 10' | 20 | |
| 8 | 65° 30' | 22 | |
| 9 | 64° 30' | 25 | |
| 10 | 63° 30' | 27 | |
| 11 | 62° 30' | 29 | |
| 12 | 61° 50' | 32 | |
| 13 | 60° 35' | 35 | |
| 14 | 59° 50' | 37 | |
| 15 | 58° 30' | 40 | |
| 16 | 57° 50' | 42 | ±.50 |
| 17 | 57° 00' | 45 | |
| 18 | 56° 00' | 47 | |
| 19 | 55° 50' | 49 | |
| 20 | 55° 00' | 51 | |
| 21 | 54° 50' | 53 | |
| 22 | 54° 10' | 56 | |
| 23 | 54° 00' | 58 | |
| 24 | 53° 10' | 61 | |
| 25 | 53° 00' | 59 | |

LAMP SYSTEM FOR OPERATING THEATRES AND THE LIKE

BACKGROUND OF THE INVENTION

Several lamps have been developed in an attempt to provide uniform illumination of a relatively large work area such as that found in an operating theatre environment. Examples of such lamps are disclosed in U.S. Pat. Nos. 4,159,511 to Dejonc (using concave reflecting surface), 4,153,929 to Laudenschlarger (using multifaceted reflector), 4,135,231 to Fisher (using coaxially-arranged, curved reflectors with a single movable light source), 3,732,417 to Nordquist (using a conventional circular reflector and prismatic lens system), 3,360,640 to Seitz et al. (using multiple, individual light sources from individual fiberglass light-conducting bundle), 3,225,184 to Reiber (using several individual light fixtures directed onto a field), 2,827,554 to Gunther et al. (using several individual light fixtures directed on a field), and 2,495,320 to Franck (using a plurality of individual light sources, each having a horizontal square 2-component refractor). All of the above references are hereby incorporated into the present disclosure by reference. Lamps of the above types have been unsatisfactory because they have failed to provide both a desired degree of uniform luminosity together with a sufficient depth of field such that the light source may be conveniently moved about the task surface without adversely affecting the luminosity characteristics.

The present invention represents an improvement in a type of lamp different from the above-referenced systems. An early lamp of this type was described by Blin in French Patent No. 1,495,007. The Blin reference teaches a lamp whose light source resides above a field of concentrically circular prisms. The light emanating from the light source passes through a toroidal lens (such as a Fresnel-type lens) which renders the beam substantially columnar and directs the columnar beam onto the prism field where the columnar beams are redirected (by internal reflection) and concentrated (by action of the prism curvature) onto a target field below the prism plane.

More recently, U.S. Pat. No. 3,941,993 to Hubert improved upon the Blin lamp by the use of straight prisms across radial sectors of the planar prism field so as to produce a prism field resembling a spider web design. Such construction provided columnar light beams emanating from a toroidal lens system so as to impinge upon straight prisms which maintain the columnarity of the light beams and overlap them from all radial sectors of the prism field into the illuminated target field. The result was an illuminated target field of greater width without the greatly intensified illumination ("hot spots") which resulted from the concentrically, inwardly curved prisms of Blin.

One of the remaining problems associated with the lamp proposed by Hubert is that its resultant, intersecting, columnar light beams provide only a narrow depth of field with uniform luminosity. The region of best illumination in such a lamp occurs over a working distance (i.e., distance from the lamp to the target field) which is quite small, and which is achieved at a point where all of the patches of light from each prism sector overlap. This effect is illustrated by the luminosity curves shown in FIG. 1*a*. The luminosity curve of the Hubert lamp is represented by the broken lines in FIG. 1*a* while the luminosity curve of the present invention is represented by solid lines. FIG. 1*a* shows that a lamp in accordance with the Hubert reference achieves uniform luminosity (seen as a plateau in the luminosity curve) at distances from about 40 inches to about 54 inches from the prism plane. At distances greater than 54 inches from the prism plane, it can be seen in FIG. 1*a* that the luminosity curve of the Hubert lamp becomes depressed in the center of the field as the intersecting columnar beams begin to diverge from their point of intersection. In practice, this effect manifests itself as a doughnut-shaped illumination with a dark center.

It has heretofore not been recognized that the depth of field can be improved by controlling the divergence, in the angular direction, of the light leaving each of the individual prisms from a given radial sector.

It is therefore desirable to produce a lamp which achieves both uniform luminosity (i.e., through the intersection of non-focused light beams) and which provides a much greater depth of field and makes such uniform illumination available to the user over a much greater range of distances between the lamp and the object or surface to be illuminated. Uniform luminosity is particularly critical in an operating theatre environment because the task surface is generally three-dimensional and particularly prone to shadowing. Providing uniform light from a number of radial sectors helps eliminate such shadowing. Greater depth of field is also important due to the desirability of having the lamp movable so as to illuminate from varying distances. This allow clearance for equipment and members of the surgical team.

It has also been the practice in the past to support such fields of prisms upon a transparent plate. A disadvantage of such an arrangement is that if such a plate becomes soiled or scratched, it must be cleaned and/or replaced. Removal of the plate for either purpose causes all of the prisms to be displaced from their normal positions in the lamp.

Therefore, it is desirable to produce a lamp of the above-described type whose prism sectors are both self-supporting and protected from soil or damage from the lamp's outside environment.

The above-described advantages and objectives are achieved by the present invention, while other such advantages and objectives will become apparent to one of ordinary skill in the art in light of the present disclosure.

SUMMARY OF THE INVENTION

The foregoing objects and advantages are achieved in the present invention which is a lamp for providing luminosity for use in an operating theatre and the like. In its most general form, the invention comprises: (a) a light source, (b) a planar field comprising radial sectors containing a plurality of outwardly curved prisms, and (c) a toroidal lens system which controls the divergence of the light emanating from the light source so as to render it substantially columnated and directs the light onto the planar field. The curvature of the transverse, outwardly curved prisms varies such that the curvature of the prisms toward the center of the field is greater than those toward the outside of the field. It is preferred that the curvature of each prism in the sequence from the inside of a given sector to the outside of a given sector is less than the curvature of a prism preceding it in the sequence of prisms from the inside of the sector to the outside of the sector. It is further preferred that the curvature of each prism in the sequence from the inside of the sector to the outside of the sector is less than the prism immediately preceding it in said sequence. It is most preferred that the curvature of the prisms be determined according to ray trace equations.

The radial sectors of the lamp of the present invention may be constructed in any manner so as to achieve their intended purpose. One such method is to provide each sector with alternating tongue and groove structures so that the entire prism assembly may be attached so as to form an integral planar prism field.

By integrally attaching the radial sectors, it is possible to construct the lamp of the present invention so as to feature an additional transparent plate or film between the prism field and the area to be illuminated. Such plate or film may be removed for cleaning, repair or replacement without the necessity of dislodging the prism sectors from their assembled positions in the prism field.

DESCRIPTION OF THE DRAWINGS

The following drawings, in which like numbers refer to like structure and features, present one embodiment of the present invention.

DETAILED DESCRIPTION OF THE PREFERRED EMBODIMENT

Figure 1:
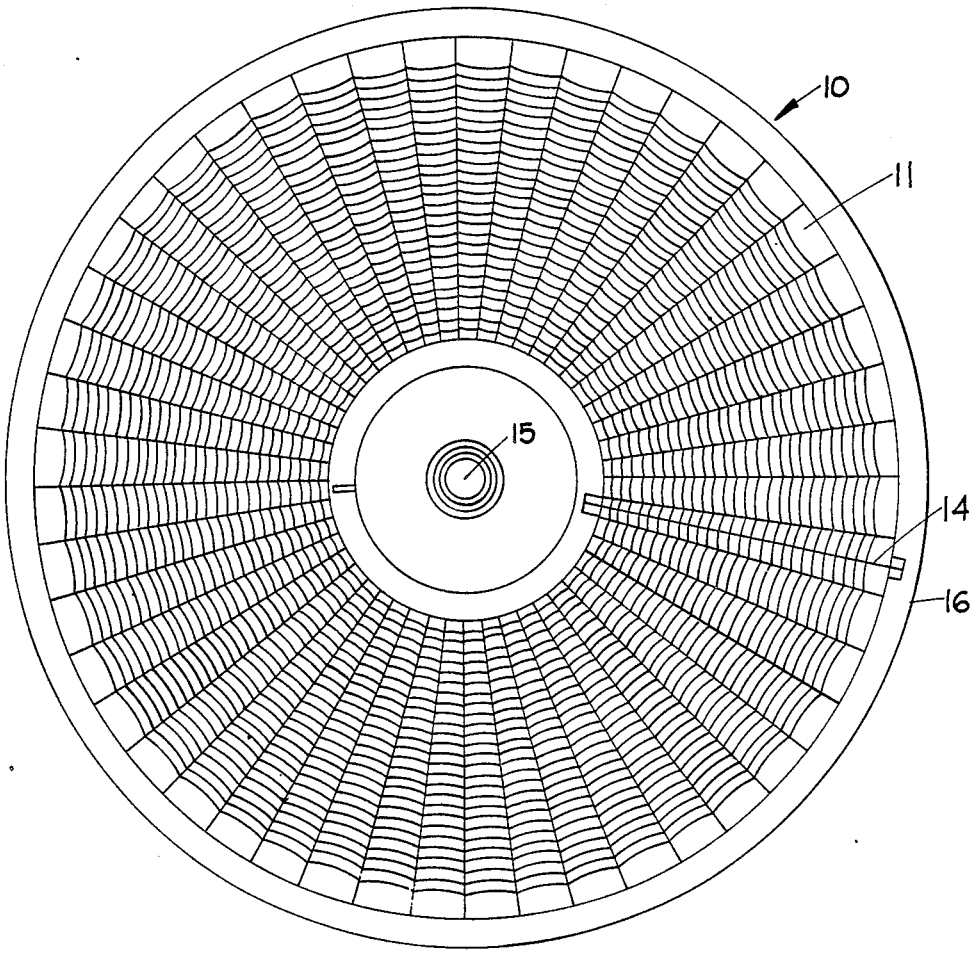
FIG. 1 is a plan view of a planar, circular prism field in accordance with one embodiment of the present invention.

In describing a preferred embodiment of the invention illustrated in the drawings, specific terminology will be resorted to for the sake of clarity. However, the invention is not intended to be limited to the specific terms so selected, and it is understood that a specific term includes all technical equivalents which operate in a similar manner to accomplish a result similar to that of the disclosed invention.

Referring to the drawings, FIG. 1 shows a planar prism field 10 comprised by individual radial sectors containing radial prism sectors such as 11. The prism sectors may be constructed of appropriate transparent, optical grade materials such as the glasses or polymers known in the art. An example of such materials include plexiglass, which is preferably molded.

Each radial sector 11 comprises a series of outwardly curved prisms as shown bracketed along longitudinal, radial axis 14. The curvature of the prisms varies such that the curvature of the prisms toward the center of the circular field 15 is relatively greater than those prisms toward the outside of the circular field 16. The curvature of the prisms may also more preferably be varied such that, from the innermost prism, the curvature of each subsequent prism in the sequence from the inside of the sector to the outside of the sector is less than a prism preceding it in the sequence, and most preferably, each prism in the sequence having a curvature less than the curvature of the prism immediately preceding it in the sequence.

Figure 2:
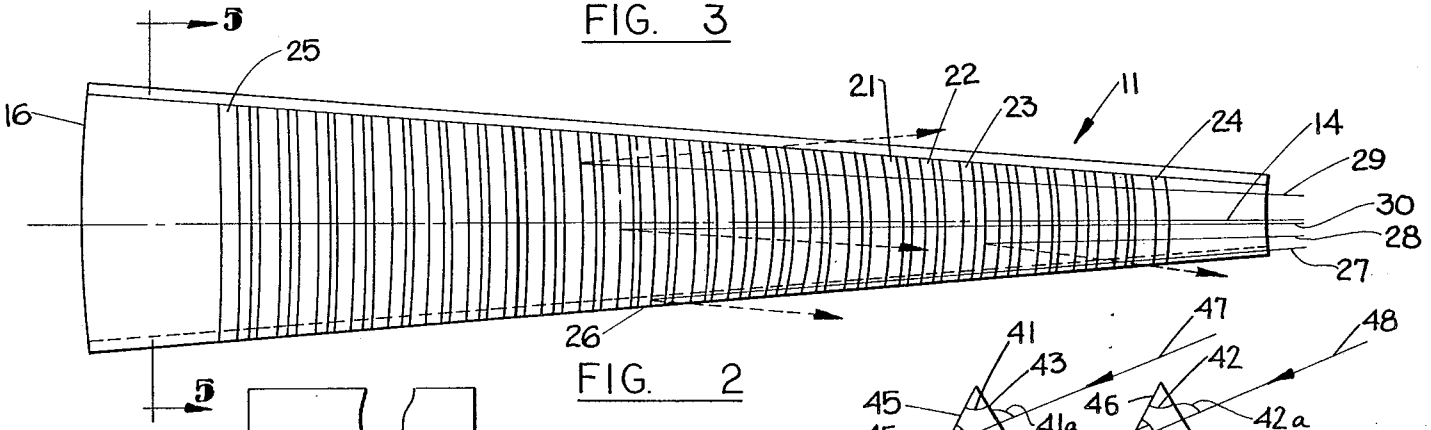
FIG. 2 is a planar view of one radial sector of the planar, circular field shown in FIG. 1.

Such an arrangement of prisms is shown in FIG. 2, which shows radial sector 11 containing a plurality of prisms such as 21, 22 and 23. The aforementioned sequence of prisms begins with innermost prism 24 and proceeds toward the edge of the planar field 16 to outermost prism 25. The prism array can also be seen in elevational view in FIG. 3.

The prisms within a given radial sector are transverse to the radial axis of that sector and their curvature is outward, i.e., concave toward the outside of the planar field. The curvature of the prisms within a given radial sector are generally such that the light emanating from the prisms is diverged in the angular direction. In this embodiment the curvature of the prisms towards the center of the planar field is greater than those toward the outside of the planar field. It is preferred that the curvature of the prisms varies such that, from the innermost prism 24, the curvature of each prism in the sequence from the inside of the radial sector to the outside of the radial sector is less than the curvature of a prism preceding it in said sequence. It is most preferred that the curvature of each prism in the sequence from the inside of the radial sector to the outside of the radial sector is less than the prism immediately preceding it in said sequence.

As pointed above, the present invention provides control of the divergence, in the angular direction, of light emanating from the prisms of a given radial sector.

Figure 1A:
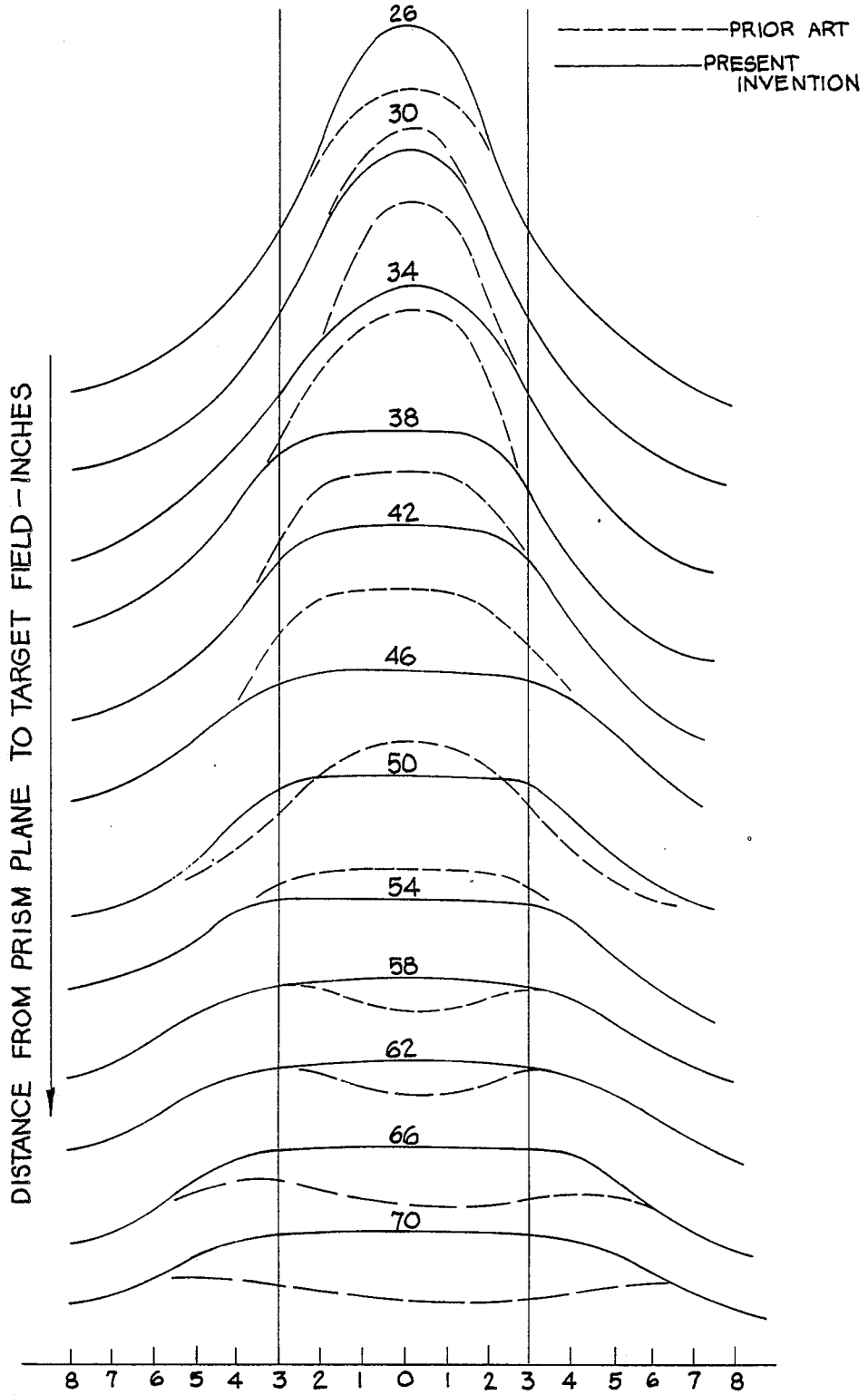
FIG. 1*a* is a luminosity curve wherein the X axis is the distance below the prism field of two lamps utilizing such prism fields.
Figure 1B:
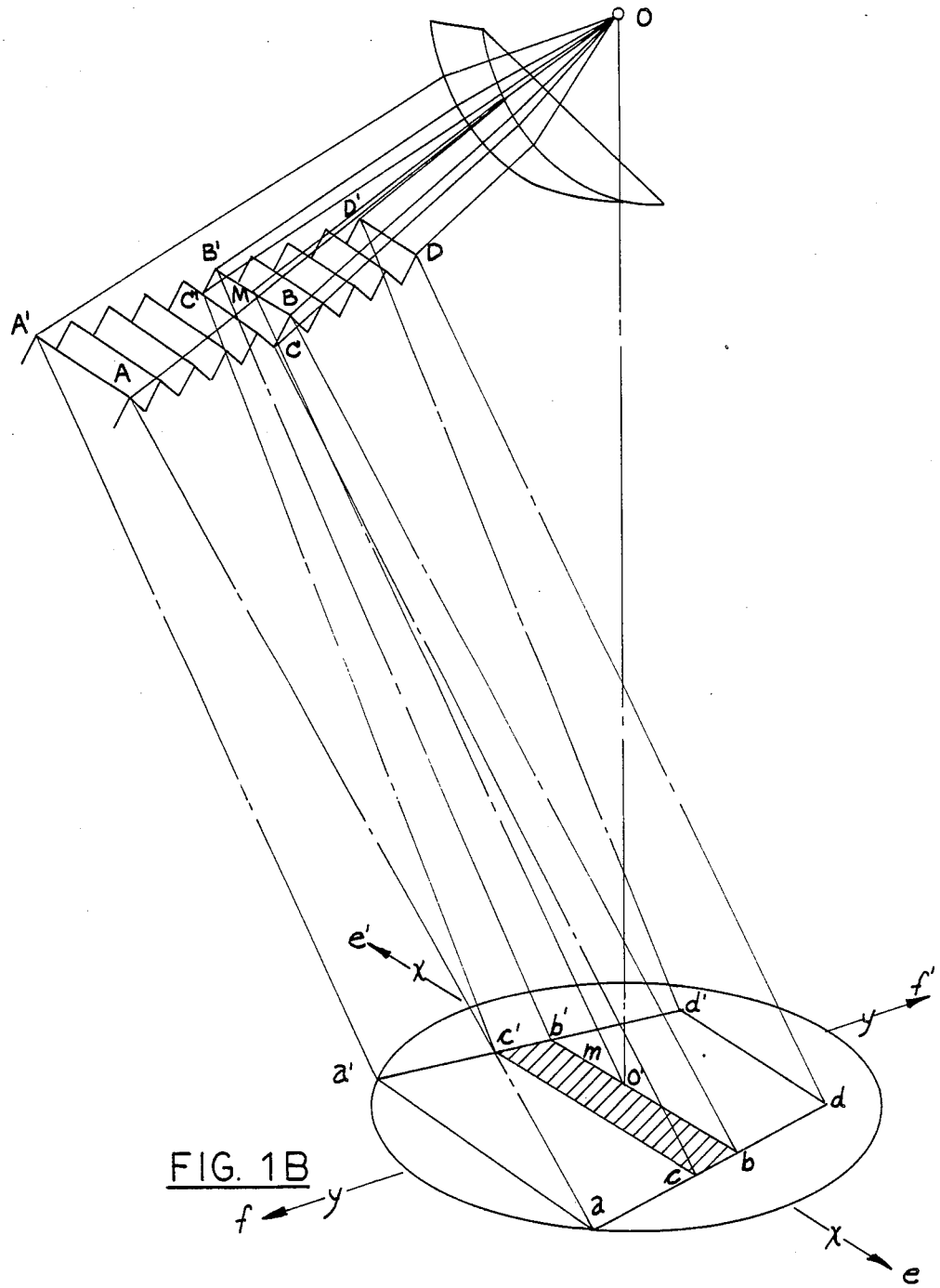
FIG. 1*b* is a ray trace drawing showing the redirection and distribution of light, toward and into a target plane, by one radial prism sector of the prior art lamp according to Hubert.
Figure 1C:
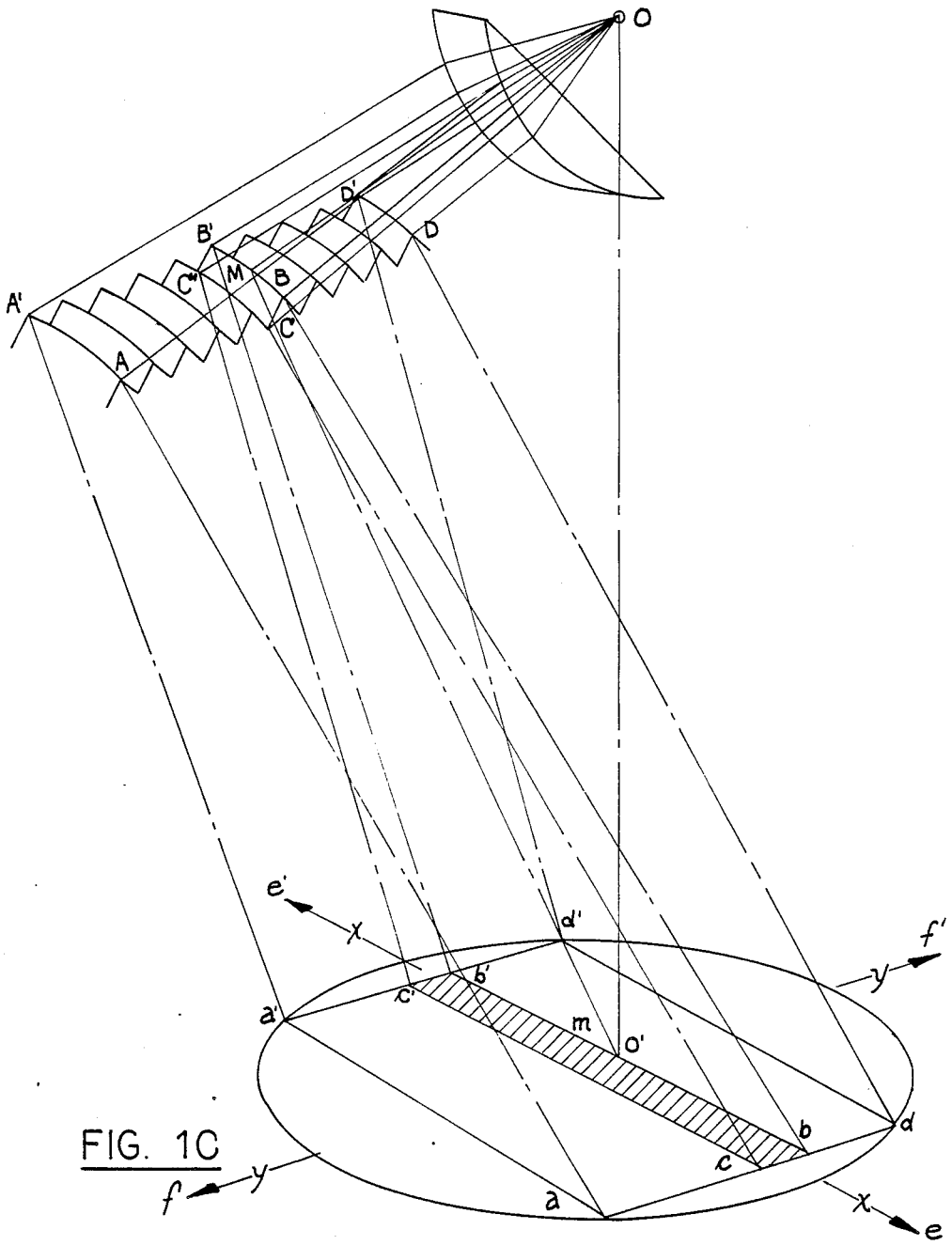
FIG. 1*c* is a ray trace drawing showing the redirection and distribution of light, toward and into a target plane, by one radial prism sector in accordance with the present invention.

As shown in FIG. 1*b*, the straight prisms of the prior art (i.e., a lamp according to Hubert), although allowing some natural divergence uniform to all prisms, do not control divergence of the light in the angular direction (i.e., along transverse axis X). Such lack of control renders the resultant patch of light trapezoidal in shape (substantially in accordance with the shape of the radial sector itself; see FIG. 1*b*). In contrast, FIG. 1*c* shows the effect of controlling divergence of the light such that lines A'a', B'b', C'c', D'd' diverge in the angular direction e' along axis X in comparison respectively to lines A'a', B'b', C'c', and D'd' shown in FIG. 1*b*. Likewise rays Aa, Bb Cc and Dd diverge in the angular direction e along axis X relative to corresponding rays Aa, Bb, Cc and Dd shown in FIG. 1*b*. The effect of controlling divergence in the angular direction allows the placement of the edge rays (i.e., A'a', B'b', C'c' and D'd'; and Aa, Bb, Cc and Dd) so as to define the sides (i.e., sides a'd'and ad, respectively) of a laterally broader light patch (i.e., light patch a'd'da). The foregoing effect is brought about by varying the curvature of prisms within a given radial sector of the planar prism field.

Figure 4:
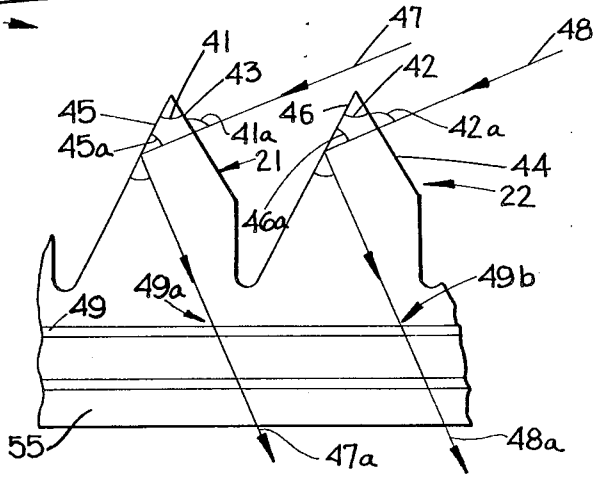
FIG. 4 is a sectioned, magnified view of two prisms in the radial sector show in FIG. 3.

The divergence of light in the radial direction is controlled either by varying the tilt angle of the reflective face of the prisms (such as varying angle 45a of reflective surface 45 as shown in FIG. 4) so as to effect divergence of the light in the radial direction; or by varying the angle of the refractive surface (such as angle 41 of refractive surface 43 as shown in FIG. 4) so as to effect divergence of the light in the radial direction by refraction; or by a combination of both. The effect of controlling the radial divergence of the light from each prism allows that patch of light attributed to a given prism to be moved along the radial or meridional axis (i.e., light patch c'b'bc from prism C'B'BC along axis Y). It is preferred to control the divergence of light in the radial direction by changing the angle of the refractive face because errors in such angle do not multiply themselves to such a great extent as those occurring as a result of errors in the angle of the reflective surface.

FIG. 4 shows a magnified, elevational view of two neighboring prisms 21 and 22 having apex angles 41 and 42, respectively. Prism 21 has refractive surface 43 and reflective surface 45, which together redirect light ray 47 toward the target plane. In like fashion, prism 22 contains refractive surface 44 and reflective surface 46 which cooperate to redirect light ray 48 to the target plane.

Figure 5:
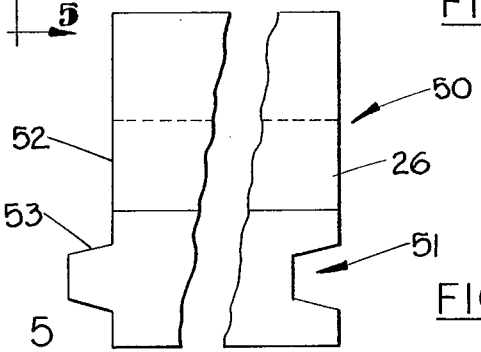
FIG. 5 is a fragmentary and view of the radial sector shown in FIG. 2.

FIG. 5 is a fragmentary end view of the radial prism sector of FIG. 2. FIG. 5 illustrates the tongue-and-groove construction by which the individual prism sectors are held together to form a planar prism field.

FIG. 5 shows sectioned radial sector 50 having side 26 containing groove 51 adapted to accept a correspondingly shaped tongue portion contained in the neighboring radial sector adjacent to side 26. Side 52, opposite side 26, contains tongue portion 53 which is adapted to fit into a correspondingly shaped groove in the radial sector adjacent to side 52. The radial sectors may also be held together by a dovetail tongue and groove arrangement. Either such tongue and groove arrangement may be supplemented by the use of appropriate mechanical support means or adhesives.

Figure 3:
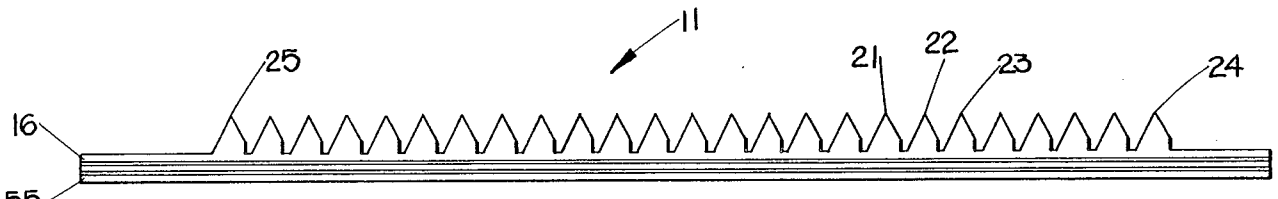
FIG. 3 is an elevational view of the radial sector shown in FIG. 2.
Figures 6, 8:
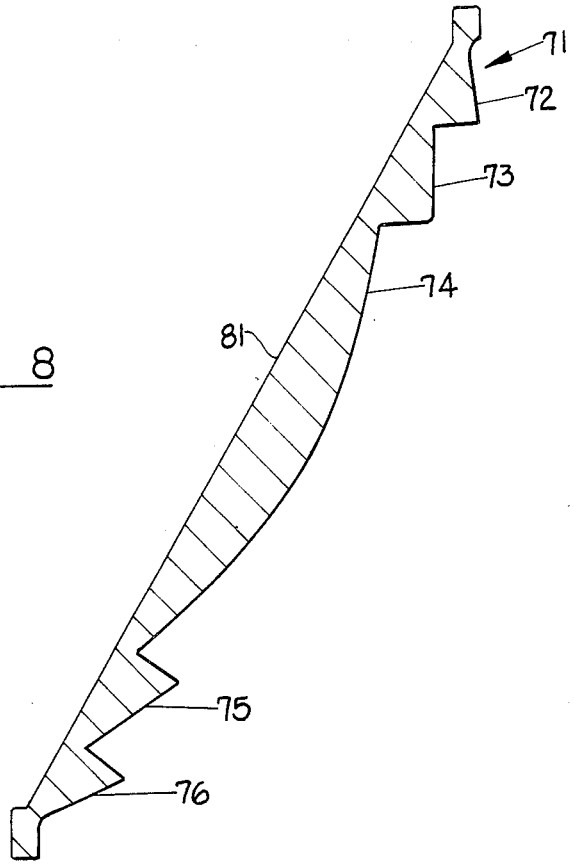
FIG. 6 is a table containing the numbers, apex angles, radii and radii tolerance of a sequence of prisms in a given radial sector of one embodiment of the present invention.
FIG. 8 is a vertical, cross-sectional view of one side of the toroidal lens system shown in FIG. 7.

FIG. 6 is a table containing the apex angles, radii and radii tolerances for a series of 25 prisms; prism number 1 in the table being the innermost prism (such as prism 24 in FIG. 3) and prism number 25 being the outermost prism (such as prism 25 in FIG. 3). The curvature of the prisms is determined by employing a set of ray trace equations. Because each prism curves in a continuous manner, the local surface normal is needed to locate the angle of incidence of a ray before the law of refraction is applied. To do this, the direction cosines of the rays from the lens to the individual prisms were determined along with the direction cosines of the local normal at the point where the rays strike the prisms. Such skew ray trace equations can be found in Herzberger, M., *Modern Geometrical Optics.* Interscience, New York (1958), or in military standardization handbook, *Optical Design.* (MIL - HDBK - 141 Department of Defense, U.S. Government printing Office (1962), both of which are hereby incorporated herein by reference. Such equations were used to determine the refraction of the ray at the front surface (e.g., 43 and 44) of the curved prisms, the reflection off the inside back surfaces (e.g., 45 and 46), and the refraction of the reflected ray out of the bottom of the prism array (through surface 49, for instance, at points 49a and 49b). The curvature of each prism is determined individually by setting a value for the prism curvature and sending a ray to one edge of the prism (edge 26,) perpendicular to the prism curve, and determining where that ray would hit in the target plane. The rationale behind this method is that finding the location of the ray at the edge of the radial sectors (e.g., ray 27, all other rays, e.g., rays 28 and 29) between the edge rays and the central rays (e.g., ray 30) fall there between. By using a standard "spreadsheet" computer program incorporating the appropriate skew ray trace equations, the effect of changing curvature of a particular prism quickly yields a new value for the ray location in the target plane. For instance, the curvature of each prism may be set so that the edge ray of each prism would be located a given number of inches from the central ray (e.g., ray Mo' in FIG. 1c and each ray bundle giving an overall patch width of two times said given number of inches.

Figure 7:
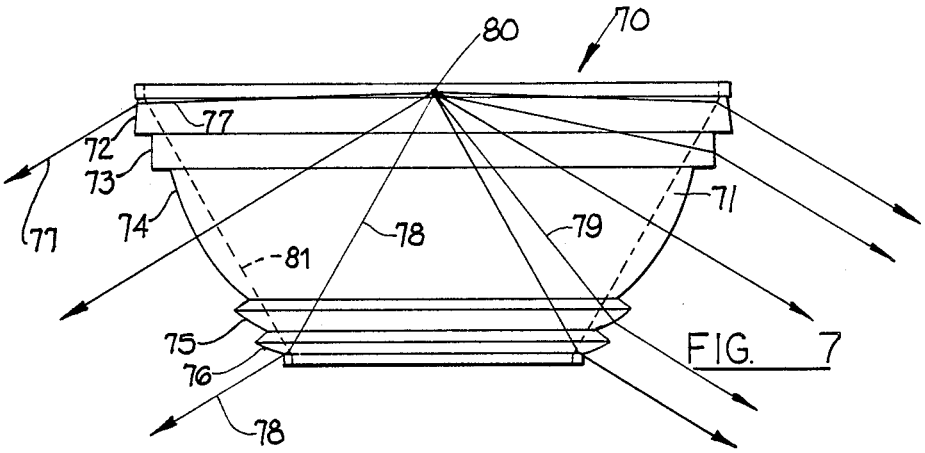
FIG. 7 is an elevational view of the toroidal lens system used in accordance with one embodiment of the present invention.

An example of the toroidal lens system used in accordance with the present invention is shown in FIGS. 7 and 8. FIG. 7 shows a conical Fresnel lens 70 having cross-sectional face 71 (also shown in FIG. 8a) The lens contains several refractive faces 72, 73, 74, 75 and 76 which cooperate to render light rays (such as 77, 78 and 79) substantially columnar subsequent to emanating from light source 80. The Fresnel lens of the present invention was designed using standard meridional ray trace equations which can be found in a number of textbooks including O'Shea, D., *Elements of Modern Optical Design.* Wylie & Sons, New York (1985), which is hereby incorporated herein by reference. Preferably, the toroidal lens would be one that would provide an evenly diverging fan of rays to illuminate all of the prisms. Due to the spherical aberration in the lens and the fact that one of the surfaces was to be flat (i.e., surface 81) the segments of each of the sections corresponding to faces 72–76 were designed to approximate the ideal divergence by "stitching" the separate sections. At the center of the lens, the rays were found to diverge slightly more than required, and at the edge of the lens, the rays were found not to diverge quite enough. One way to compensate for this design result (i.e., the fact that the angle of incidence of the various rays varied from prism to prism) was done by adjusting the entrance face angle of the prism surfaces (such as angles 41a and 42a of prism faces 43 and 44, respectively, vis-a-vis, light rays 47 and 48, respectively) so as to deliver the ray through the center of the face to the back surface of the prisms (i.e., surfaces 45 and 46, respectively) at the same angle (i.e., angle 45a and 46a, being equal). Because all of the prism angles between the base of the prism array (i.e., surface 49) and the individual prism reflecting surfaces (i.e., 45 and 46) were set at the same angle, such arrangement assured that the central ray in each bundle of rays emerging from the bottom of the prism arrays was parallel to the neighboring central rays (i e., rays 47a and 48a, being parallel).

The light source used in accordance with the present invention may be any appropriate light source having single or multiple filaments and of various appropriate intensities. It is preferred that appropriate changes to the toroidal lens system be made in order to properly account for light sources which use multiple filaments. This may be done, for instance, by using more than one toroidal lens in order to properly distribute the light to the planar prism field. In the case of multiple filaments, stacked toroidal lenses may be used to properly capture and columnate the light from each filament, and redistribute such light onto the prism field.

Another aspect of the present invention is the provision of a transparent plate or film between the prism field and the area to be illuminated. The position of such a plate or film can be seen in FIGS. 3 and 4 as Item 55. The plate or film 55 may be made of any suitable transparent material, preferably optical grade, such as the glasses or plexiglass known in the art.

Figure 9:
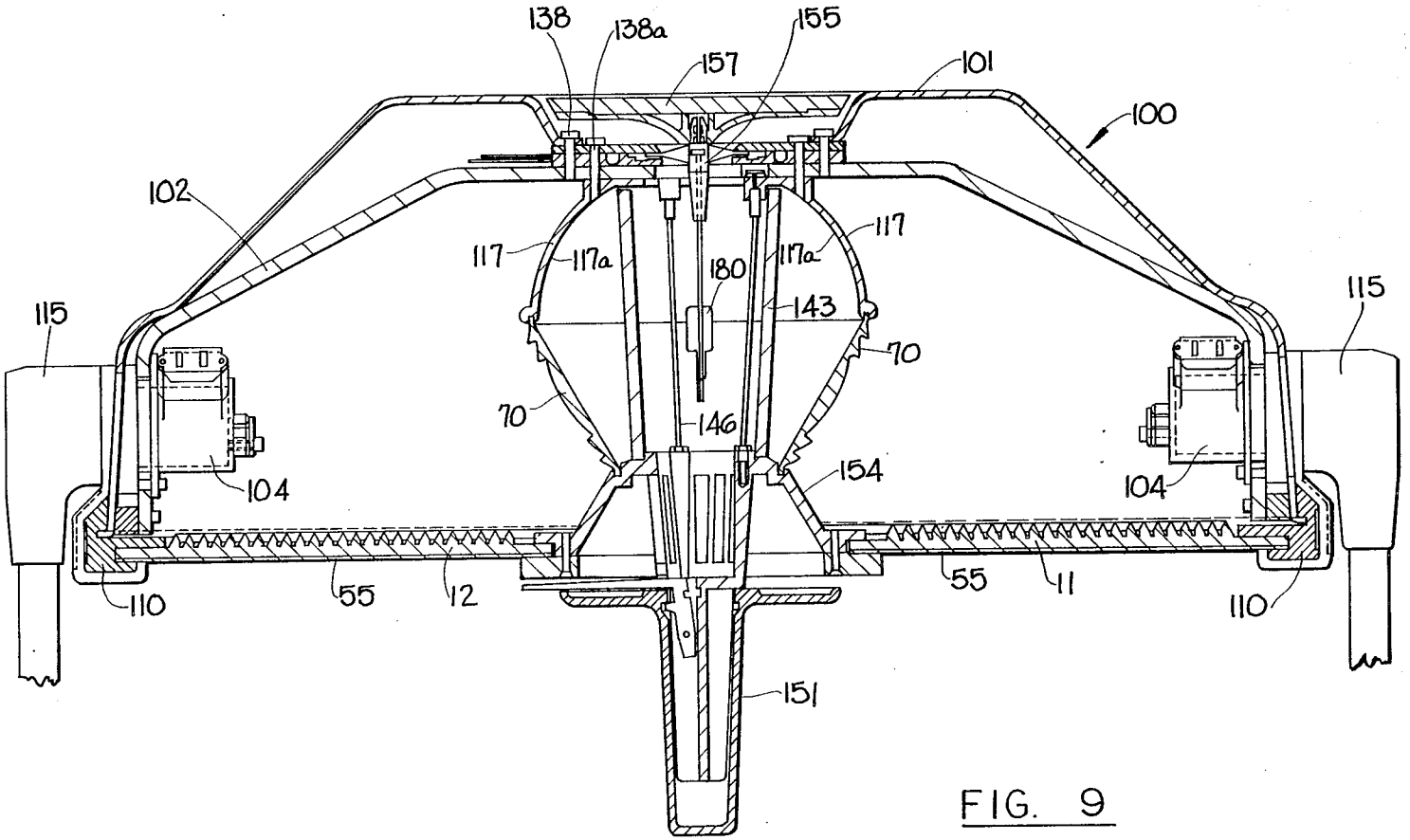
FIG. 9 is a cross-sectional elevational view of an assembled lamp in accordance with one embodiment of the present invention.

FIG. 9 shows a cross-sectioned, elevational view of a lamp 100 made in accordance with the present invention. FIG. 9 shows the position of radial prism sectors 11 and 12 and protective plate or film 55. The upper portion is protected by cupola 101 and is supported by internal structural support member 102. The assembly is held in place by tension cable assembly 146 and may be pivoted about pivot ends 115 on commutators 104. The lower inner handle 154 supports Fresnel lens 70 as well as the inner portions of the radial prism sectors such as 11 and 12. The light source 180 is provided with an infrared shield 143 to protect Fresnel lens 70. The light source 180 is held in place by bulb holder assembly. 155. Bolts 138 and **138*a* hold the cupola 101, internal structural support 102 and Fresnel lens support 117 in position as shown in FIG. 10. Fresnel lens support 117 contains spherically concave reflective surface 117*a* which redirects light diverging above the light source 180 onto Fresnel lens 70. The lamp may be positioned by and with the aid of sterile handle 151 or by a circumferential handle (not shown) about the circumference of the prism field. The outer edge of the prism sectors is held in position by outer support 110 in cooperation with lower inner handle portion 154. The protective plate or shield 55 may also be held in position by the cooperation of outer support member 110 and lower inner handle portion 154 as can be appreciated from FIG. 9**.

In light of the above disclosure, it is apparent that one of ordinary skill in the art may be able to make modifications, variations and improvements upon the present invention without departing from its spirit.

What is claimed is:

1. A lamp providing uniform luminosity in an area to be illuminated, such as in an operating theatre and the like, comprising:

(a) a light source;

(b) a planar field, said planar field comprising a substantial number of radial sectors containing a plurality of transverse, outwardly curved prisms; and (c) a toroidal lens system which renders the light emanating from said light source substantially columnar and directs said light onto said planar field.

2. The lamp according to claim 1 wherein the curvature of said transverse, outwardly curved prisms varies such that the curvature of the prisms toward the center of said planar field is greater than the curvature of the prisms toward the outside of said planar field.

3. The lamp according to claim 1 wherein the curvature of said transverse, outwardly curved prisms varies such that, from the innermost prism, the curvature of each prism in the sequence from the inside of said sector to the outside of said sector is less than the curvature of a prism preceding it in said sequence.

4. The lamp according to claim 1 wherein the curvature of said transverse, outwardly curved prisms varies such that, from the innermost prism, the curvature of each prism in the sequence from the inside of said sector to the outside of said sector is less than the curvature of the prism immediately preceding it in said sequence.

5. The lamp according to claim 1 wherein said radial sectors are held together in said planar field by attachment to one another.

6. The lamp according to claim 5 wherein said radial sectors are held together in said planar field by cooperation of tongue-and-groove means on the lateral sides of said radial sectors.

7. The lamp according to claim 1 wherein said lamp further comprises:

(d) a transparent member located between said planar field and said area to be illuminated.

8. A lamp providing uniform luminosity in an area to be illuminated, such as in an operating theatre and the like, comprising:

(a) a light source;

(b) a planar field, said planar field comprising a substantial number of radial sectors containing a plurality of transverse, outwardly curved prisms, wherein the curvature of said transverse, outwardly curved prisms varies such that, from the innermost prism, the curvature of each prism in the sequence from the inside of said sector to the outside of said sector is less than the curvature of the prism immediately preceding it in said sequence; and (c) a toroidal lens system which renders the light emanating from said light source substantially columnar and directs said light onto said planar, circular field.

9. A lamp providing uniform luminosity in an area to be illuminated, such as in an operating theatre and the like, comprising:

(a) a light source;

(b) a planar field, said planar field comprising a substantial number of radial sectors containing a plurality of transverse, curved prisms, wherein the curvatures of a substantial number of said prisms vary from one another so as to allow divergence, in the angular direction, of light rays passing therethrough;

(c) a toroidal lens system which renders the light emanating from said light source substantially columnar and directs said light onto said planar field.

* * * * *